US010019898B2

(12) United States Patent
Miller

(10) Patent No.: US 10,019,898 B2
(45) Date of Patent: Jul. 10, 2018

(54) SYSTEMS AND METHODS TO DETECT VEHICLE QUEUE LENGTHS OF VEHICLES STOPPED AT A TRAFFIC LIGHT SIGNAL

(71) Applicant: Siemens Industry, Inc., Alpharetta, GA (US)

(72) Inventor: David Dodd Miller, Austin, TX (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 249 days.

(21) Appl. No.: 15/091,170

(22) Filed: Apr. 5, 2016

(65) Prior Publication Data

US 2017/0206783 A1 Jul. 20, 2017

Related U.S. Application Data

(60) Provisional application No. 62/278,491, filed on Jan. 14, 2016.

(51) Int. Cl.

| | |
|---|---|
| ***G08G 1/08*** | (2006.01) |
| ***G08G 1/01*** | (2006.01) |
| ***G08G 1/052*** | (2006.01) |

(52) U.S. Cl.

CPC ..... *G08G 1/08* (2013.01); *G08G 1/0112* (2013.01); *G08G 1/0116* (2013.01); *G08G 1/0145* (2013.01); *G08G 1/052* (2013.01)

(58) Field of Classification Search

CPC ..... G08G 1/08; G08G 1/052; G08G 1/0145; G08G 1/0112; G08G 1/0116

See application file for complete search history.

(56) References Cited

U.S. PATENT DOCUMENTS

| | | | | |
|---|---|---|---|---|
| 8,344,909 | B2 | 1/2013 | Teffer et al. | |
| 8,386,156 | B2 | 2/2013 | Miller | |
| 8,442,749 | B2 | 5/2013 | Teffer et al. | |
| 8,478,500 | B1 * | 7/2013 | Vahidi | B60T 7/18 340/932 |
| 8,519,868 | B2 | 8/2013 | Nadeem et al. | |
| 8,531,520 | B2 | 9/2013 | Stricklin et al. | |
| 8,762,037 | B2 | 6/2014 | Teffer et al. | |
| 8,976,041 | B2 | 3/2015 | Buckel | |
| 9,013,325 | B2 | 4/2015 | Miller et al. | |

(Continued)

*Primary Examiner* — Khoi H Tran
*Assistant Examiner* — Majdi Alsomiri

(57) ABSTRACT

A connected traffic monitoring system comprises at least one Roadside Unit (RSU) and a traffic signal controller. The roadside unit is configured to transmit wireless signals, receive corresponding responses from a first Onboard Unit (OBU)-equipped vehicle and a second OBU-equipped vehicle and send data from the first OBU-equipped vehicle and the second OBU-equipped vehicle to the traffic signal controller. The traffic signal controller to calculate a distance between the first Onboard Unit (OBU)-equipped vehicle and the second OBU-equipped vehicle in a vehicle queue associated with a traffic light signal on an intersection, determine the queue length of the vehicle queue, determine whether the distance between the first OBU-equipped vehicle and the second OBU-equipped vehicle is greater than a vehicle length and if the distance is determined greater than the vehicle length, detect at least one non-OBU-equipped vehicle stopped in the vehicle queue behind the first OBU-equipped vehicle.

15 Claims, 4 Drawing Sheets

(56) References Cited

U.S. PATENT DOCUMENTS 9,135,824 B1 9/2015 Collar
9,165,467 B2 * 10/2015 Nerayoff ..... H04N 7/181
9,672,734 B1 * 6/2017 Ratnasingam ..... G08G 1/0112
9,773,410 B2 * 9/2017 Vorona ..... G08G 1/0133
2005/0278082 A1 * 12/2005 Weekes ..... G07C 5/008 701/1
2009/0231160 A1 * 9/2009 Ramasubbu ..... G08G 1/07 340/917
2010/0004839 A1 * 1/2010 Yokoyama ..... G08G 1/052 701/70
2010/0017104 A1 * 1/2010 Kwong ..... G08G 1/0104 701/117
2010/0094532 A1 * 4/2010 Vorona ..... G08G 1/0104 701/119
2010/0145600 A1 * 6/2010 Son ..... B60W 50/14 701/123
2012/0029798 A1 2/2012 Miller
2012/0065871 A1 * 3/2012 Deshpande ..... G08G 1/0112 701/118
2013/0297387 A1 * 11/2013 Michael ..... G08G 1/0112 705/13
2013/0342370 A1 * 12/2013 Sharma ..... G08G 1/08 340/907
2014/0132425 A1 * 5/2014 Buckel ..... G08G 1/017 340/933
2014/0210644 A1 * 7/2014 Breed ..... G01S 17/936 340/905
2014/0232561 A1 * 8/2014 Musachio ..... G08G 1/07 340/932
2014/0266798 A1 * 9/2014 Witte ..... G08G 1/0112 340/907
2015/0339920 A1 * 11/2015 Cortelyou ..... G08G 1/01 340/907
2016/0027299 A1 * 1/2016 Raamot ..... G08G 1/08 340/917
2016/0189544 A1 * 6/2016 Ricci ..... G07C 5/008 701/117
2016/0328961 A1 * 11/2016 Garces Cadenas .... G01V 3/081
2017/0178506 A1 * 6/2017 Witte ..... G08G 1/096

* cited by examiner

SYSTEMS AND METHODS TO DETECT VEHICLE QUEUE LENGTHS OF VEHICLES STOPPED AT A TRAFFIC LIGHT SIGNAL

CROSS REFERENCE TO RELATED APPLICATIONS

This application claims the benefit of U.S. Provisional Application Ser. No. 62/278,491 entitled "SYSTEM AND METHOD TO DETECT VEHICLE QUEUES," filed on Jan. 14, 2016, the contents of which are hereby incorporated by reference herein in their entirety.

BACKGROUND

1. Field

Aspects of the present invention generally relate to detecting vehicle queues and more specifically relate to a connected vehicle system and a method for precisely determining a vehicle queue length based on the number of vehicles that are stopped in a vehicle queue at a traffic light signal.

2. Description of the Related Art

Connected vehicles are becoming a reality, which takes driver assistance towards its logical goal: a fully automated network of cars aware of each other and their environment. A connected vehicle system makes mobility safer by connecting cars to everything.

Vehicular communications systems are networks in which vehicles and roadside units (RSUs) are the communicating nodes, providing each other with information, such as safety warnings and traffic information. They can be effective in avoiding accidents and traffic congestion. Both types of nodes are generally dedicated short-range communications (DSRC) devices. DSRC works in 5.9 GHz band with bandwidth of 75 MHz and approximate range of 1000 m.

Vehicular communications systems are usually developed as a part of intelligent transportation systems (ITS). For example, a Vehicle to Vehicle (V2V) communications system is an automobile technology designed to allow automobiles to "talk" to each other. These systems generally use a region of the 5.9 GHz band set aside by the United States Congress in 1999, the unlicensed frequency also used by Wi-Fi. The V2V communications system is currently in active development by many car makers.

Traffic control devices cannot precisely determine the number of vehicles that are stopped in queues. U.S. Pat. No. 8,386,156 describes a system and method for lane-specific vehicle detection and control. U.S. Patent Application Publication No. 2012/0029798 describes a vehicle detection method using On-Board Units (OBUs) that transmit vehicle location, direction heading and speed multiple times per second. Used in conjunction, the two technologies can provide traffic signal controllers with a precise arrival time for each vehicle.

This problem of how to precisely determine the number of vehicles that are stopped in queues is solved up to now by following ways: a) Loop Detectors: a single bit indicates that one or more metallic objects occupy the loop, b) Video Detectors: a single bit per each moving objects within the camera field of view, c) Radar Detector: it indicates vehicle approach and velocity, d) Magnetometers: a single bit indicates that a vehicle occupies the magnetic sensor, and e) On-board Unit (OBU): a vehicle transmits location, direction heading and speed 10 times per second.

However, public budgets often leave detection devices in disrepair or inoperable due to adverse weather conditions than can blind optical systems, such as video detectors. The effectiveness of the two technologies of lane-specific vehicle detection, control and use of On-Board Units (OBUs) is relative to the penetration of vehicles equipped with OBUs, which may take years to reach a significant percentage of total traffic volume.

Therefore, there is a need for improvements in vehicle queue length detection for efficiently controlling traffic light signals.

SUMMARY

Briefly described, aspects of the present invention relate to a mechanism to detect a queue length of a vehicle queue at a traffic light signal. In particular, a traffic monitoring system comprises a traffic signal controller and at least one Roadside Unit (RSU) located at an intersection. The roadside unit (RSU) is configured to transmit wireless signals and receive corresponding responses from a corresponding wireless device of a first Onboard Unit (OBU)-equipped vehicle and a second OBU-equipped vehicle. The roadside unit (RSU) sends vehicle data from the first OBU-equipped vehicle and the second OBU-equipped vehicle to the traffic signal controller. The traffic signal controller determines a queue length of a vehicle queue associated with a traffic light signal on the intersection. The traffic signal controller does this by detecting one or more non-OBU-equipped vehicles stopped in the vehicle queue behind the first OBU-equipped vehicle based on the distance between the first OBU-equipped vehicle and the second OBU-equipped vehicle being greater or smaller than the vehicle length. One of ordinary skill in the art appreciates that such a traffic monitoring system can be configured to be installed in different environments where vehicular communication between vehicles and Roadside Units (RSUs) is used, for example in providing each other with traffic information which can be effective in avoiding traffic congestion.

In accordance with one illustrative embodiment of the present invention, a method is described for detecting a queue length of a vehicle queue at a traffic light signal. The method comprises calculating a distance between a first Onboard Unit (OBU)-equipped vehicle and a second OBU-equipped vehicle in the vehicle queue associated with the traffic light signal, determining whether the distance between the first OBU-equipped vehicle and the second OBU-equipped vehicle is greater than a vehicle length of an OBU-equipped vehicle, if the distance is determined greater than the vehicle length, detecting at least one non-OBU-equipped vehicle stopped in the vehicle queue behind the first OBU-equipped vehicle and determining the queue length of the vehicle queue based on the first OBU-equipped vehicle, the second OBU-equipped vehicle and an outcome of a comparison between the distance and the vehicle length to control the traffic light signal.

Consistent with another embodiment, a connected vehicle traffic monitoring system is described. The system comprises a traffic signal controller and at least one Roadside Unit (RSU) located at an intersection. The Roadside Unit (RSU) comprising at least a processor and a wireless transceiver. The Roadside Unit (RSU) is configured to transmit wireless signals and receive corresponding responses from a corresponding wireless device of a first Onboard Unit (OBU)-equipped vehicle and a second OBU-equipped vehicle, and to send at least one of vehicle location data, elevation data, direction heading data and speed data from the first OBU-equipped vehicle and the second OBU-equipped vehicle to the traffic signal controller. The traffic signal controller or the RSU to calculate a distance between the first Onboard Unit (OBU)-equipped vehicle and the second OBU-equipped vehicle in a vehicle queue associated with a traffic light signal on the intersection, determine the queue length of the vehicle queue based on the first OBU-equipped vehicle and the second OBU-equipped vehicle, determine whether the distance between the first OBU-equipped vehicle and the second OBU-equipped vehicle is greater than a vehicle length of an OBU-equipped vehicle and if the distance is determined greater than the vehicle length, detect at least one non-OBU-equipped vehicle stopped in the vehicle queue behind the first OBU-equipped vehicle.

According to yet another embodiment of the present invention, a traffic signal controller is described. The traffic signal controller comprises a processor, a wireless transceiver, and a storage media coupled to the processor. The storage media to store a software module to calculate a distance between a first Onboard Unit (OBU)-equipped vehicle and a second OBU-equipped vehicle in a vehicle queue associated with a traffic light signal on an intersection, determine a queue length of the vehicle queue based on the first OBU-equipped vehicle and the second OBU-equipped vehicle, determine whether the distance between the first OBU-equipped vehicle and the second OBU-equipped vehicle is greater than a vehicle length of an OBU-equipped vehicle and if the distance is determined greater than the vehicle length, detect at least one non-OBU-equipped vehicle stopped in the vehicle queue behind the first OBU-equipped vehicle.

DETAILED DESCRIPTION

To facilitate an understanding of embodiments, principles, and features of the present invention, they are explained hereinafter with reference to implementation in illustrative embodiments. In particular, they are described in the context of a traffic monitoring system that detects a queue length of a vehicle queue at a traffic light signal. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

In a traffic monitoring system, some vehicles are equipped with an On-Board Unit (OBU). The traffic monitoring system uses at least one Roadside Unit (RSU). The traffic monitoring system detects a queue length of a vehicle queue at a traffic light signal. The roadside unit (RSU) wirelessly sends vehicle data from a first OBU-equipped vehicle and a second OBU-equipped vehicle to a traffic signal controller. The traffic signal controller determines the queue length of the vehicle queue associated with the traffic light signal on the intersection. To this end, the traffic signal controller detects one or more non-OBU-equipped vehicles stopped in the vehicle queue behind the first OBU-equipped vehicle based on the distance calculated between the first OBU-equipped vehicle and the second OBU-equipped vehicle being greater or smaller than a vehicle length.

Figure 1:
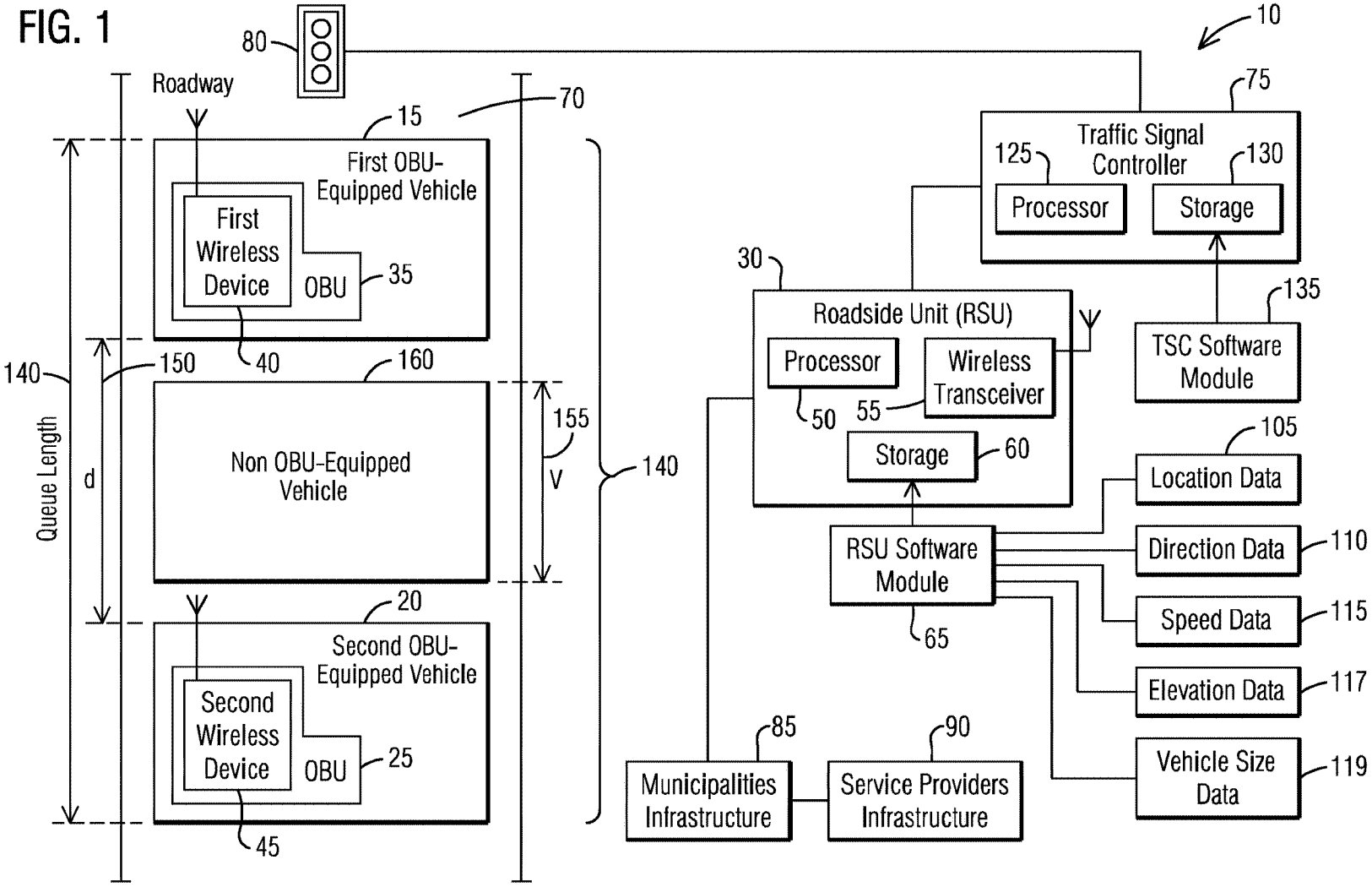
FIG. 1 illustrates a schematic of a connected vehicle traffic monitoring system that detects a queue length of a vehicle queue at a traffic light signal in accordance with an exemplary embodiment of the present invention.

FIG. 1 illustrates a schematic of a connected vehicle traffic monitoring system 10 for detecting a queue length of a vehicle queue at a traffic light signal in accordance with an exemplary embodiment of the present invention. The connected vehicle traffic monitoring system 10 provides vehicular communications as a part of an intelligent transportation system (ITS). The connected vehicle traffic monitoring system 10 may enable a network for vehicular communications in which a first On-board Unit (OBU)-equipped vehicle 15, a second On-board Unit (OBU)-equipped vehicle 20 with help of a Roadside Unit (RSU) 30 act as communicating nodes, providing each other with information, such as traffic information. Consistent with one embodiment, these types of communicating nodes may use dedicated short-range communications (DSRC) devices. DSRC work in the 5.9 GHz frequency band with bandwidth of 75 MHz and has an approximate range of 1000 m.

As used herein, "a vehicle V equipped with an On-board Unit (OBU)" refers to a vehicle that connects to sensors, decision-making systems and control systems for enabling a safety system for connected and unconnected vehicles. As used herein, "a non-On-board Unit (OBU)-equipped vehicle or a vehicle V unequipped with an Onboard Unit (OBU)" refers to a vehicle that does not have an OBU installed on it but connects to sensors, decision-making systems and control systems via a Roadside Unit (RSU) for enabling a traffic safety system for connected and unconnected vehicles. The "connected vehicle traffic monitoring system," in addition to the exemplary hardware description above, refers to a system that is configured to provide communications from Vehicle to either another Vehicle (V2V) or to roadside Infrastructure (V2I) for creating an ecosystem of connected vehicles, operated by a controller (including but not limited to smart infrastructure equipment connected to traffic signal light controllers and traffic management systems, and others). The connected vehicle traffic monitoring system can include multiple interacting systems, whether located together or apart, that together perform processes as described herein.

The first On-board Unit (OBU)-equipped vehicle 15 includes an OBU or OB device 35 that privately and securely: a). transmits vehicle location, elevation, heading and speed to nearby vehicles ten times per second, b). receives location, elevation, heading and speed from nearby vehicles, c). receives lane locations from the Roadside Unit (RSU) 30, d). receives traffic signal countdown from the RSU 30, and e). receives associated signal phase to lane from the RSU 30 to know which signal to obey. However, the U.S. Department of Transportation (DOT) defines three classes of OBU devices: i. Class 1: OBU built into the new vehicle, ii. Class 2: OBU available as an aftermarket device for older vehicles, cyclists and pedestrians, and iii. Class 3: OBU available as a smart phone app for drivers, cyclists and pedestrians. Creation and use of this data is not limited to vehicles, but can be created and used by other moving objects, such as pedestrians and bicycles.

The techniques described herein can be particularly useful for using an On-board Unit (OBU) or OB device. While particular embodiments are described in terms of On-board Unit (OBU), the techniques described herein are not limited to On-board Unit (OBU) but can also use other Vehicle to Vehicle/Infrastructure/Traffic Management System (V2X) empowered software and hardware such as other smart automotive interactive communication modules.

The second On-board Unit (OBU)-equipped vehicle 20 includes an OBU or OB device 25 that privately and securely provides the same functionality as the OBU 35. In the first On-board Unit (OBU)-equipped vehicle 15, the On-board Unit (OBU) 35 includes a first wireless device 40. Likewise, the On-board Unit (OBU) 25 includes a second wireless device 45.

The Roadside Unit (RSU) 30 includes a processor 50, a wireless transceiver 55, and a storage media 60 to store a software module 65. The Roadside Unit (RSU) 30 may be located at an intersection or near a roadway 70. The Roadside Unit (RSU) 30 may be coupled to a traffic signal controller 75 connected to a traffic signal 80. The Roadside Unit (RSU) 30 may be coupled to municipalities infrastructure 85 which in turn are connected to service providers infrastructure 90.

In a cloud, via a switch a RSU provisioning and network management server, a certification authority and a gateway to other networks of the municipalities infrastructure 85 may be connected to the Roadside Unit (RSU) 30. The municipalities infrastructure 85 may handle registrations, subscriptions, operations, rules, management and maintenance. The service providers infrastructure 90 may include an Original Equipment Manufacturer (OEM)/Internet Service Provider (ISP) applications server, a content and services server, and an OBU provisioning server. It should be appreciated that several other components may be included in the municipalities infrastructure 85 and the service providers infrastructure 90. However, the function and use of such equipment for a traffic control application are well known in the art and are not discussed further.

In operation, the Roadside Unit (RSU) 30 may be configured to transmit wireless signals and receive corresponding responses from the first wireless device 40 of the first On-board Unit (OBU)-equipped vehicle 15, and to send vehicle location data 105, direction heading data 110 and speed data 115 from the first OBU-equipped vehicle 15 to the traffic signal controller 75. The Roadside Unit (RSU) 30 may be configured to transmit wireless signals and receive corresponding responses from the second wireless device 45 of the second On-board Unit (OBU)-equipped vehicle 20, and to send the vehicle location data 105, the direction heading data 110 and the speed data 115 from the second OBU-equipped vehicle 20 to the traffic signal controller 75. The first On-board Unit (OBU)-equipped vehicle 15 and/or the second OBU-equipped vehicle 20 may additionally send elevation data 117 and vehicle size data 119. When the vehicle size data 119 is sent by an OBU, further determining whether the gap between the first On-board Unit (OBU)-equipped vehicle 15 and the second OBU-equipped vehicle 20 is occupied by a vehicle length of an OBU-equipped vehicle or occupied by unequipped vehicles.

An example of the vehicle location data 105 is GPS co-ordinates, i.e., longitude and latitude co-ordinates of a global location on the surface of Earth by a Global Positioning System (GPS) such as via a Google Maps APP or via a hardware GPS chip. An example of the direction heading data 110 may be a direction indication indicating a north (N), south (S), east (E), west (W), SE, ES, WS, or NW direction. An example of the speed data 115 may be a vehicle speed value on the roadway 70.

The traffic signal controller 75 includes a processor 125 and a storage media 130 to store a software module 135. The traffic signal controller 75 may be located at an intersection or near the roadway 70. The traffic signal controller 75 is connected to the traffic signal 80. The traffic signal controller 75 controls phases or color states of the traffic signal 80.

The software module 135 of the traffic signal controller 75 or OBU may calculate a distance between the first On-board Unit (OBU)-equipped vehicle 15 and the second OBU-equipped vehicle 20 in a vehicle queue 140 associated with a traffic light signal such as the traffic signal 80 on the intersection. The software module 135 may determine a queue length 145 of the vehicle queue 140 based on the first OBU-equipped vehicle 15 and the second OBU-equipped vehicle 20. The queue length 145 may be calculated by the RSU 30 itself, or by the RSU 30 when connected to the traffic signal controller 75 or by the traffic signal controller 75 using message data from the RSU 30. The software module 135 may determine whether a distance d 150 between the first OBU-equipped vehicle 15 and the second OBU-equipped vehicle 20 is greater than a vehicle length v 155 of an OBU-equipped vehicle or a non-OBU-equipped vehicle. If the distance d 150 is determined to be greater than the vehicle length v 155, the software module 135 may detect at least one non-OBU-equipped vehicle 160 stopped in the vehicle queue 140 behind the first OBU-equipped vehicle 15. If the vehicle size data 119 is sent, the software module 135 may additionally determine whether the space between the first OBU-equipped vehicle 15 and the second OBU-equipped vehicle 20 is occupied by unequipped light vehicles or by the trailer of the OBU-equipped truck.

In one embodiment, the first OBU-equipped vehicle 15 and the second OBU-equipped vehicle 20 may also send vehicle size information that may be used to determine whether the space between two OBU locations is occupied by several unequipped light vehicles or by a trailer of an OBU-equipped truck.

In one embodiment, the distance d 150 between the first OBU-equipped vehicle 15 and the second OBU-equipped vehicle 20 may be calculated, for example, in inches based on the data from the OBUs 25, 35. For example, based on one or more of the vehicle location data 105, the direction heading data 110 and the speed data 115 from the OBUs 25, 35. The vehicle length v 155 may be based on the average lengths of compact sedans and compact sport utility vehicles in U.S. being 177.2 inches and 172.3 inches, respectively. Medium sedans and SUVs are 10 to 20 inches longer than their compact counterparts, while large cars are longer by a further 15 to 20 inches.

If a length difference between the distance d 150 and vehicle length v 155 is determined to be more than one vehicle length v in inches, then for precisely determining the number of vehicles that are stopped in vehicle queue 140 the software module 135 may determine multiples of the vehicle length v 155 in inches among the difference in inches to determine an exact count of vehicles. In this way, the queue length 145 of the vehicle queue 140 may be determined more precisely based on information from the first OBU-equipped vehicle 15 and the second OBU-equipped vehicle 20.

The software module 135 may detect a change in the traffic signal 80 from a green phase to a red phase. The software module 135 may determine a traffic lane geometry map associated with the traffic signal 80 for the vehicle queue 140. For example, the traffic lane geometry map may include a physical geometry of an intersection, covering the location and width of each approaching lane, egress lane, and valid paths between approaches and egresses. The software module 135 may initiate for the traffic lane geometry map a green status by the traffic signal controller 75 based on the queue length 145 of the vehicle queue 140. The software module 135 may terminate the green status of the traffic lane geometry map when no vehicle presence is detected in the traffic lane geometry map.

After detecting the non-OBU-equipped vehicle 160 stopped in the vehicle queue 140 behind the first OBU-equipped vehicle 15, the software module 135 may update the queue length 145 of the vehicle queue 140 to include the non-OBU-equipped vehicle 160. The software module 135 may control a transition from one phase to another phase of the traffic signal 80 based on the updated queue length of the vehicle queue 140.

For example, for a longer length of the queue length 145, the traffic signal 80 may be kept ON longer in the green phase before turning it to a red phase. In this way, by turning ON the traffic signal 80 of an intersection having many traffic light signals in a green phase longer based on the queue length 145 of a specific lane, e.g., the roadway 70 having relatively more vehicular traffic than other lanes of that intersection unnecessary delays in traffic can be avoided or minimized and traffic congestion may be reduced. In one or more lanes with less vehicular traffic on the intersection as known from a size of their queue lengths, the green phase of a traffic light signal may be turned ON for a relatively shorter period compared to a duration of the green phase of the traffic signal 80.

Figure 2:
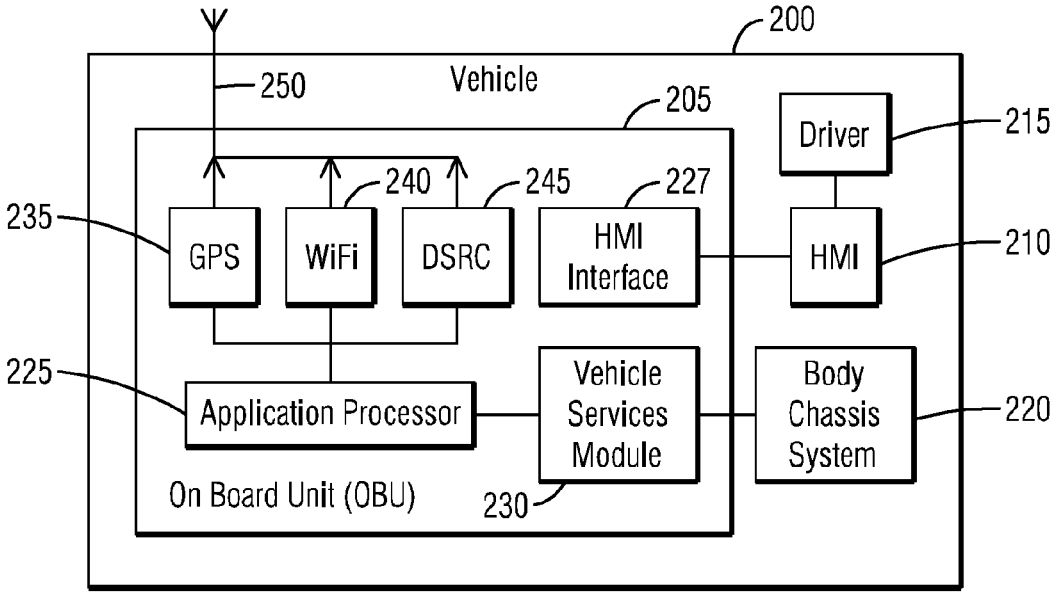
FIG. 2 illustrates a schematic of an Onboard Unit (OBU)-equipped vehicle equipped with an Onboard Unit (OBU) in accordance with an exemplary embodiment of the present invention.

Referring to FIG. 2, it illustrates a schematic of an On-board Unit (OBU)-equipped vehicle 200 equipped with an On-board Unit (OBU) 205 in accordance with an exemplary embodiment of the present invention. The OBU-equipped vehicle 200 may include a Human Machine Interface (HMI) 210 for a driver 215 to interface with the OBU 205. The OBU-equipped vehicle 200 may also include a body chassis system 220 to interface with the OBU 205.

In one embodiment, the OBU 205 may include an application processor 225, a HMI interface 227, and a vehicle services module 230. The OBU 205 may further include a GPS chip 235, a Wi-Fi transceiver 240, a Dedicated Short-Range Communications (DSRC) device 245, and an antenna 250 to which they are coupled for conducting wireless communications.

As shown, the HMI interface 227 is coupled to the HMI 210 and the vehicle services module 230 is coupled to the body chassis system 220. The GPS chip 235 provides GPS communications for determining and communicating location of the OBU-equipped vehicle 200. The Wi-Fi transceiver 240 provides communications to Wi-Fi hotspots and other ISP networks to connect the OBU-equipped vehicle 200 to the Internet. As a part of an intelligent transportation system (ITS), the DSRC device 245 may operate as a network node to provide dedicated short-range vehicular communications in 5.9 GHz band with bandwidth of 75 MHz and has an approximate range of 1000 m.

Figure 3:
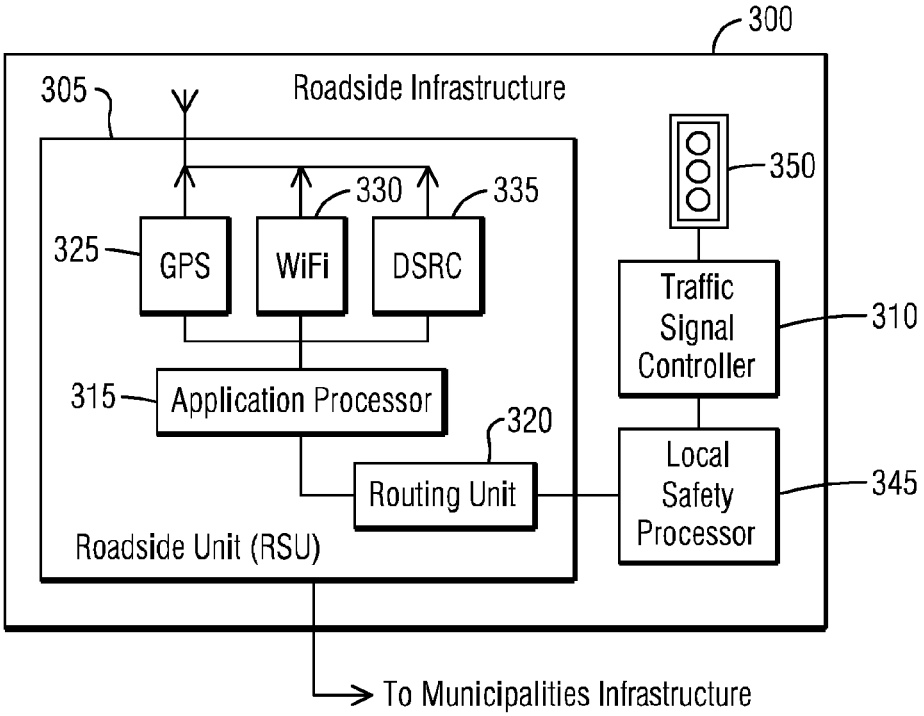
FIG. 3 illustrates a schematic of roadside infrastructure including a Roadside Unit (RSU) and a traffic signal controller in accordance with an exemplary embodiment of the present invention.

Turning now to FIG. 3, it illustrates a schematic of roadside infrastructure 300 including a Roadside Unit (RSU) 305 and a traffic signal controller 310 in accordance with an exemplary embodiment of the present invention. In one embodiment, the RSU 305 may include an application processor 315 and a routing unit 320. The RSU 305 may further include a GPS chip 325, a Wi-Fi transceiver 330, a Dedicated Short-Range Communications (DSRC) device 335, and an antenna 340 to which they are coupled for conducting wireless communications.

The routing unit 320 may be coupled to a local safety processor 345 which connects to the traffic signal controller 310 linked to a traffic signal 350. The routing unit 320 may further couple the RSU 305 to the municipalities infrastructure 85 of FIG. 1.

The GPS chip 325 provides GPS communications for determining and communicating location information of a non-OBU-equipped vehicle. The Wi-Fi transceiver 330 provides communications to Wi-Fi hotspots and other ISP networks to connect the RSU 305 to the Internet. As a part of an intelligent transportation system (ITS), the DSRC device 335 may operate as a network node to provide dedicated short-range vehicular communications in 5.9 GHz band with bandwidth of 75 MHz in an approximate range of 1000 m.

Figure 4:
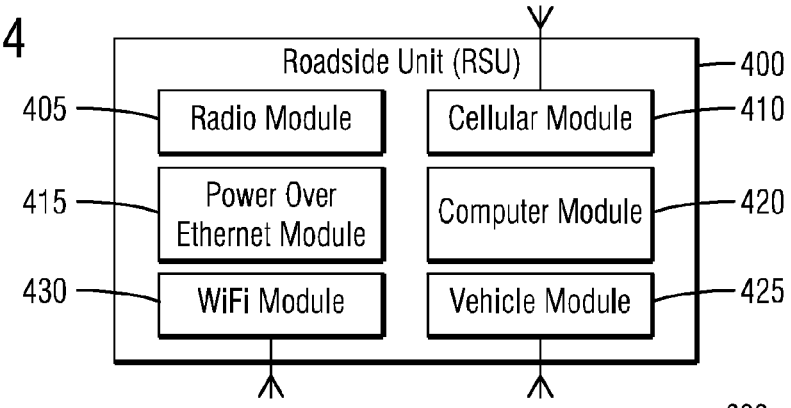
FIG. 4 illustrates a schematic of a Roadside Unit (RSU) in accordance with an exemplary embodiment of the present invention.

FIG. 4 illustrates a schematic of a Roadside Unit (RSU) 400 in accordance with another exemplary embodiment of the present invention. In one embodiment, the RSU 400 may include a radio module 405, a cellular module 410, a power over Ethernet module 415, a computer module 420, a vehicle module 425 and a Wi-Fi module 430. The cellular module 410 may provide mobile communications with cell phones of drivers. The power over Ethernet module 415 may provide a wired Internet connection to the RSU 400. The vehicle module 425 may support the non-On-board Unit (OBU)-equipped vehicle 20 and the On-board Unit (OBU)-equipped vehicle 15 related activities of the connected vehicle traffic safety system 10 of FIG. 1.

The radio module 405 may include a DSRC device to operate as a network node to provide dedicated short-range vehicular communications in 5.9 GHz band with bandwidth of 75 MHz in an approximate range of 1000 m. The computer module 420 may include a processor to execute a traffic control software stored in a storage device for the RSU 400. The Wi-Fi module 430 provides communications to Wi-Fi hotspots and other ISP networks to wirelessly connect the RSU 400 to the Internet.

Figure 5:
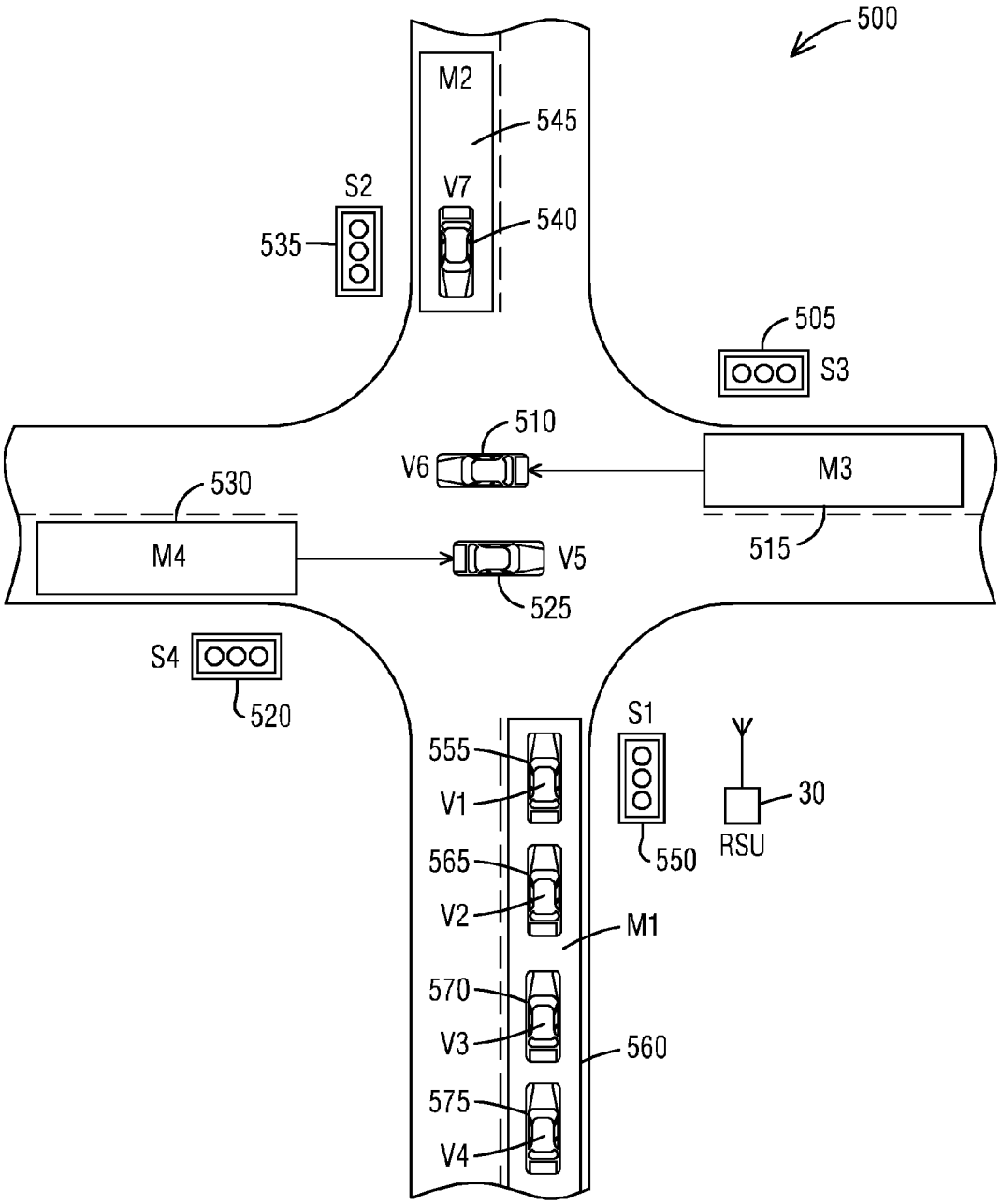
FIG. 5 illustrates an embodiment of a vehicle queue detection system in accordance with one illustrative embodiment of the present invention.

As shown in FIG. 5, it illustrates an embodiment of a vehicle queue detection system 500 in accordance with one illustrative embodiment of the present invention. This vehicle queue detection system 500 describes a mechanism for vehicle detection and it includes traffic control software to detect vehicle queues.

FIG. 5 depicts the operation of the vehicle queue detection system 500. To determine the number of vehicles that are stopped in queues, a precise arrival time for each vehicle may be determined from U.S. Pat. No. 8,386,156 and U.S. Patent Application Publication No. 2012/0029798, as set forth below. A more accurate queue length may be determined by providing a precise queue length for optimal signal control. The method of detecting vehicle queues incorporates some steps from U.S. Pat. No. 8,386,156 and U.S. Patent Application Publication No. 2012/0029798 as described next. Contents of both U.S. Pat. No. 8,386,156 and U.S. Patent Application Publication No. 2012/0029798 are incorporated by reference in their entirety.

U.S. Pat. No. 8,386,156 describes a system and method for lane-specific vehicle detection and control. In U.S. Pat. No. 8,386,156, lane-specific vehicle detection and control may be done by a roadside equipment (RSE) system that can be used for controlling traffic signals and other equipment. A lane-specific vehicle detection and control method includes wirelessly receiving vehicle data from an onboard equipment (OBE) system connected to a vehicle, the vehicle data including location data, time data, and vehicle identification data related to the vehicle. The method further includes determining motion data for the vehicle and determining the current state of at least one traffic device. The method further includes determining a roadway lane corresponding to the vehicle, based on the motion data and the current state of the at least one traffic device, and storing the vehicle and associated roadway lane.

U.S. Patent Application Publication No. 2012/0029798 describes a vehicle detection method using OBUs that transmit vehicle location, heading and speed multiple times per second. In U.S. Patent Application Publication No. 2012/0029798, a vehicle detection method uses OBUs that transmit vehicle location, heading and speed multiple times per second and uses a roadside equipment (RSE) system that can be used for controlling traffic signals and other equipment. The vehicle detection method includes wirelessly receiving vehicle data by an RSE system and from an onboard equipment (OBE) system connected to a vehicle. The vehicle data includes location data, time data, and vehicle identification data related to the vehicle. The method further includes determining a most recent location of the vehicle by the RSE system and from the vehicle data, comparing the most recent location of the vehicle to a previous location of the vehicle, and producing a control signal based on the comparison.

Consistent with one embodiment, the steps of detecting vehicle queues are: a) the RSU 30 receives nearby vehicle locations, direction headings and speeds and forwards to it to the traffic signal controller 75, b) a traffic signal S3 505 changes from a Red phase to a Green phase, an OBU-equipped vehicle V6 510 starts through the intersection, c) the software module 135 determines that a lane geometry map M3 515 is associated with the traffic signal S3 505, d) a traffic signal S4 520 changes from a Red phase to a Green phase, an OBU-equipped vehicle V5 525 starts through the intersection, e) the software module 135 determines that a lane geometry map M4 530 is associated with the traffic signal S4 520, f) a traffic signal S2 535 changed from a Green phase to a Red phase, an OBU-equipped vehicle V7 540 stops, g) the software module 135 determines that a lane geometry map M2 545 is associated with the traffic signal S2 535, h) a traffic signal S1 550 changed from a Green phase to a Red phase, an OBU-equipped vehicle V1 555 stops, i) the software module 135 determines that a lane geometry map M1 560 is associated with the traffic signal S1 550, k) non-equipped vehicles V2 565 and V3 570 stop in the queue behind the OBU-equipped vehicle V1 555, l) an OBU-equipped vehicle V4 575 stops in the queue behind the vehicle V3 570, m) the traffic signal controller 75 is aware of two vehicles in the M1 560 queue.

Then in step n) the software module 135 calculates the distance between all of the OBU-equipped vehicles in the queue M1 560, o) the software module 135 determines that the distance between the OBU-equipped vehicle V1 555 and the OBU-equipped vehicle V4 575 is greater than two vehicle lengths, p) the software module 135 determines that the actual M1 queue 560 is correctly 4 vehicles, not 2 vehicles, or q) the software module 135 determines that queue M1 560 contains a mixture of light and heavy vehicles of unequal lengths, r) the software module 135 initiates M1 560 Green appropriate for the improved total queue length, s) the software module 135 terminates M1 560 Green when no vehicle presence is detected in M1 560.

Advantages of the embodiments of the present invention include: a) the vehicle queue detection system 500 improves upon the effectiveness of a queue length determination as more accurate queue length is calculated, b) the vehicle queue detection system 500 provides a precise queue length for an optimal traffic signal control, c) the vehicle queue detection system 500 is effective during the years of increasing OBU penetration into traffic, and d) the vehicle queue detection system 500 is effective for vehicles, cyclists and pedestrians, i.e., crosswalk queues of pedestrians.

The technical features which contribute to above advantages include: a) the vehicle queue detection system 500 identifies intersection MAP and queues b) the vehicle queue detection system 500 further calculates distances between OBU-equipped vehicles in queues, c) the vehicle queue detection system 500 further identifies gaps between vehicles that are unequipped vehicles or longer vehicles, d) the vehicle queue detection system 500 further calculates a more accurate queue length, and e) the vehicle queue detection system 500 further controls traffic more effectively, using the more accurate vehicle queue lengths.

Figure 6:
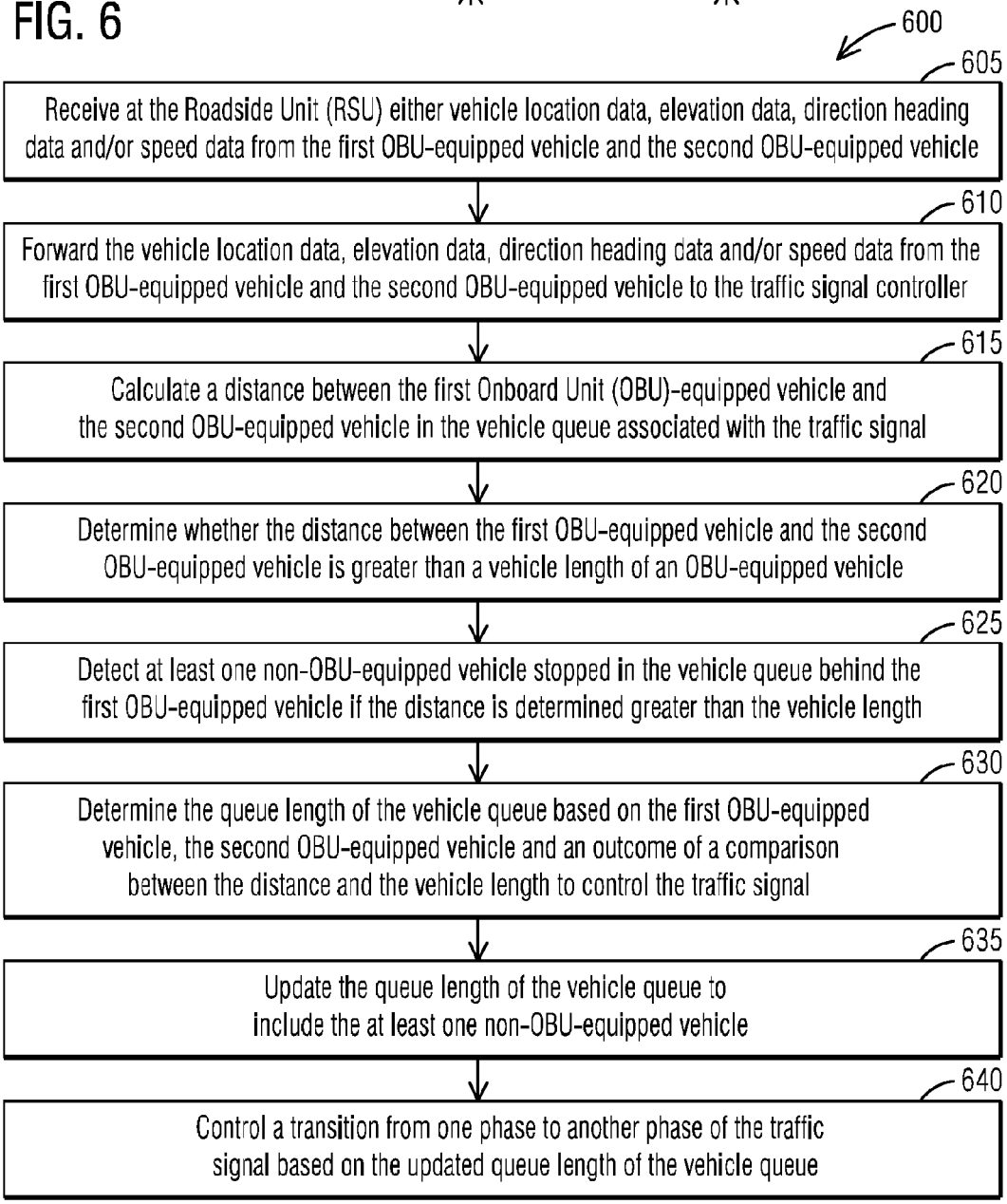
FIG. 6 illustrates a flow chart of a method of detecting a queue length of a vehicle queue at a traffic light signal in accordance with an exemplary embodiment of the present invention.

As seen in FIG. 6, it illustrates a flow chart of a method 600 of detecting the queue length 145 of the vehicle queue 140 at the traffic signal 80 in accordance with an exemplary embodiment of the present invention. Reference is made to the elements and features described in FIGS. 1-5. It should be appreciated that some steps are not required to be performed in any particular order, and that some steps are optional.

The method 600 includes in step 605 receiving at the roadside unit (RSU) 30 either vehicle location data, direction heading data and/or speed data from the first OBU-equipped vehicle 15 and the second OBU-equipped vehicle 20. The method 600 further includes in step 610 forwarding the vehicle location data, direction heading data and/or speed data from the first OBU-equipped vehicle 15 and the second OBU-equipped vehicle 20 to the traffic signal controller 75.

The method 600 further includes in step 615 calculating a distance between the first Onboard Unit (OBU)-equipped vehicle 15 and the second OBU-equipped vehicle 20 in the vehicle queue 140 associated with the traffic signal 80. The method 600 further includes in step 620 determining whether the distance between the first OBU-equipped vehicle 15 and the second OBU-equipped vehicle 20 is greater than a vehicle length of an OBU-equipped vehicle. The method 600 further includes in step 625 detecting at least one non-OBU-equipped vehicle 160 stopped in the vehicle queue 140 behind the first OBU-equipped vehicle 15 if the distance is determined greater than the vehicle length. The method 600 further includes in step 630 determining the queue length 145 of the vehicle queue 140 based on the first OBU-equipped vehicle 15, the second OBU-equipped vehicle 20 and an outcome of a comparison between the distance and the vehicle length to control the traffic signal 80.

The method 600 further includes in step 635 updating the queue length 145 of the vehicle queue 140 to include the at least one non-OBU-equipped vehicle 160. The method 600 further includes in step 640 controlling a transition from one phase to another phase of the traffic signal 80 based on the updated queue length of the vehicle queue 140.

Every new OBU equipped vehicle may receive J2735 standard messages via 5.9 GHz DSRC for driver safety. In one embodiment, a significant percentage of all vehicles must be equipped with OBUs for the connected vehicle traffic monitoring system 10 of FIG. 1 to be effective. As an alternative, each vehicle could be equipped with an after-market Class 2 OBU or with a Class 3 smart phone APP. The OBU equipped vehicles supplement the received OBU messages with vehicle sensor data such as front radar, back radar, side radar, backup cameras and other devices to detect unequipped vehicles, pedestrians and cyclists.

The connected vehicle traffic monitoring system 10 may use Dedicated Short-Range Communications (DSRC) as a medium range wireless communication channel dedicated to OBU vehicles to provide communications from Vehicle to either another Vehicle (V2V) or to roadside Infrastructure (V2I). On-Board-Units (OBUs) may be retrofitted to existing cars or built into new cars, with the goal of creating an ecosystem of connected vehicles.

The connected vehicle traffic monitoring system 10 may enable DSRC empowered Vehicle-to-Pedestrian communication through an "APP." The connected vehicle traffic monitoring system 10 may make pedestrians an active part of the V2V and V2I landscape through their smart phones.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A method of detecting a queue length of a vehicle queue at a traffic light signal, the method comprising:

calculating a distance between a first Onboard Unit (OBU)-equipped vehicle and a second OBU-equipped vehicle in the vehicle queue associated with the traffic light signal;

determining whether the distance between the first OBU-equipped vehicle and the second OBU-equipped vehicle is greater than a vehicle length of an OBU-equipped vehicle;

if the distance is determined greater than the vehicle length, detecting at least one non-OBU-equipped vehicle stopped in the vehicle queue behind the first OBU-equipped vehicle;

determining the queue length of the vehicle queue based on the first OBU-equipped vehicle, the second OBU-equipped vehicle and an outcome of a comparison between the distance and the vehicle length to control the traffic light signal; and transmitting wireless signals from the first OBU-equipped vehicle and the second OBU-equipped vehicle including at least one of vehicle location data, elevation data, direction heading data and speed data to a Roadside Unit (RSU).

2. The method of claim 1, further comprising:

detecting a change in the traffic light signal from a green phase to a red phase.

3. The method of claim 2, further comprising:

determining a traffic lane geometry map associated with the traffic light signal for the vehicle queue.

4. The method of claim 3, further comprising:

initiating for the traffic lane geometry map a green status by a traffic signal controller based on the queue length of the vehicle queue.

5. The method of claim 4, further comprising:

terminating the green status of the traffic lane geometry map when no vehicle presence is detected in the traffic lane geometry map.

6. The method of claim 1, further comprising:

receiving at the roadside unit (RSU) the at least one of vehicle location data, elevation data, direction heading data and speed data from the first OBU-equipped vehicle and the second OBU-equipped vehicle; and forwarding the at least one of vehicle location data, elevation data, direction heading data and speed data from the first OBU-equipped vehicle and the second OBU-equipped vehicle to a traffic signal controller.

7. The method of claim 1, further comprising:

updating the queue length of the vehicle queue to include the at least one non-OBU-equipped vehicle.

8. The method of claim 7, further comprising:

controlling a transition from one phase to another phase of the traffic light signal based on the updated queue length of the vehicle queue.

9. The method of claim 1, further comprising:

identifying an intersection MAP and associated vehicle queues corresponding to respective traffic light signals of an intersection relating to the traffic light signal;

calculating distances between Onboard Unit (OBU)-equipped vehicles in the associated vehicle queues; and identifying gaps between the OBU-equipped vehicles to calculate more accurate queue lengths of the associated vehicle queues.

10. A connected vehicle traffic monitoring system, the system comprising:

a traffic signal controller; and at least one Roadside Unit (RSU) located at an intersection, the roadside unit (RSU) comprising at least a processor and a wireless transceiver, the roadside unit (RSU) configured to transmit wireless signals and receive corresponding responses from a corresponding wireless device of a first Onboard Unit (OBU)-equipped vehicle and a second OBU-equipped vehicle, and to send at least one of vehicle location data, elevation data, direction heading data and speed data from the first OBU-equipped vehicle and the second OBU-equipped vehicle to the traffic signal controller, wherein the traffic signal controller to:

calculate a distance between the first Onboard Unit (OBU)-equipped vehicle and the second OBU-equipped vehicle in a vehicle queue associated with a traffic light signal on the intersection;

determine the queue length of the vehicle queue based on the first OBU-equipped vehicle and the second OBU-equipped vehicle;

determine whether the distance between the first OBU-equipped vehicle and the second OBU-equipped vehicle is greater than a vehicle length of an OBU-equipped vehicle; and if the distance is determined greater than the vehicle length, detect at least one non-OBU-equipped vehicle stopped in the vehicle queue behind the first OBU-equipped vehicle.

11. The system of claim 10, wherein the traffic signal controller to:

detect a change in the traffic light signal from a green phase to a red phase.

12. The system of claim 11, wherein the traffic signal controller to:

determine a traffic lane geometry map associated with the traffic light signal for the vehicle queue;

initiate for the traffic lane geometry map a green status by a traffic signal controller based on the queue length of the vehicle queue; and terminate the green status of the traffic lane geometry map when no vehicle presence is detected in the traffic lane geometry map.

13. The system of claim 10, wherein the first OBU-equipped vehicle and the second OBU-equipped vehicle to transmit wireless signals including at least one of vehicle location data, direction heading data and speed data to a Roadside Unit (RSU).

14. The system of claim 13, wherein the roadside unit (RSU) device to receive the at least one of vehicle location data, direction heading data and speed data from the first OBU-equipped vehicle and the second OBU-equipped vehicle and forward the at least one of vehicle location data, direction heading data and speed data from the first OBU-equipped vehicle and the second OBU-equipped vehicle to the traffic signal controller.

15. The system of claim 10, wherein the traffic signal controller to:

update the queue length of the vehicle queue to include the at least one non-OBU-equipped vehicle; and control a transition from one phase to another phase of the traffic light signal based on the updated queue length of the vehicle queue.

* * * * *